United States Patent [19]

Holmquist

[11] Patent Number: 4,962,855

[45] Date of Patent: Oct. 16, 1990

[54] SYSTEM FOR LOADING THIN-WALLED PLASTIC FLOWER POTS ONTO A LOADING TRAY

[75] Inventor: Marlon E. Holmquist, St. Paul, Minn.

[73] Assignee: T. O. Plastics, Inc., Minneapolis, Minn.

[21] Appl. No.: 357,032

[22] Filed: May 25, 1989

[51] Int. Cl.[5] ..... B65D 1/34; B65D 85/50

[52] U.S. Cl. ..... 206/423; 47/66; 47/86; 220/23.8; 217/26.5

[58] Field of Search ..... 220/23.4, 85 H; 47/66, 47/79, 84, 86; 217/25.5, 26, 26.5; 206/423

[56] References Cited

U.S. PATENT DOCUMENTS

| | | | |
|---|---|---|---|
| 3,502,241 | 3/1970 | Smith | 47/86 |
| 3,539,071 | 10/1970 | Ludder | 47/86 |
| 3,624,788 | 11/1971 | McMahon | 220/85 H |
| 3,667,647 | 6/1972 | Van Daalen | 217/26 |
| 3,965,616 | 6/1976 | Ridgeway | 47/66 |
| 4,008,543 | 2/1977 | Vilt | 47/86 |
| 4,242,834 | 1/1981 | Olsen | 47/86 |
| 4,684,013 | 8/1987 | Jacobs | 206/564 |

FOREIGN PATENT DOCUMENTS

| | | | |
|---|---|---|---|
| 1250573 | 12/1960 | France | 217/26.5 |
| 7713224 | 6/1979 | Netherlands | 47/86 |
| 2032886 | 5/1980 | United Kingdom | 217/26.5 |
| 1575886 | 10/1980 | United Kingdom | 47/86 |

*Primary Examiner*—George E. Lowrance
*Attorney, Agent, or Firm*—Jacobson and Johnson

[57] ABSTRACT

Thin-walled plastic flower pots are stacked upside down with a plurality of stacks arranged in a preset spaced manner and a loading tray having a number of cavities spaced the same as the stacks of pots formed to receive and hold a pot from each of the stacks is used to lift the pots off the stacks. Each cavity has a horizontal rib located near the bottom for grasping and lifting off the topmost pot in each stack when the tray is placed with the open end of the cavity over each of the corresponding stacks of pots and then pushed gently onto the stacks of flower pots and then lifted off. The flower pots have means for providing a gap between the bottoms of each successive stacked flower pot so that the rib of the cavity grasps the flower pot in the gap between the bottom of the topmost flower pot in the stack and the next lower flower pot.

7 Claims, 4 Drawing Sheets

SYSTEM FOR LOADING THIN-WALLED PLASTIC FLOWER POTS ONTO A LOADING TRAY

FIELD OF THE INVENTION

The invention is for use with thin-walled plastic flower pots used in commercial wholesale greenhouses for growing, processing and distributing ornamental and floracultural plants. It is not intended for use with conventional clay flower pots or heavy patio-type planters.

In mechanized or automated operations of nurseries, in general empty flower pots are placed on a conveyor belt and then carried past or under stations where soil, fertilizer, seeds, and plants (or combinations thereof) are deposited into the flower pot and then the pot is carted away for further care, processing, shipment, storage or display. Generally the flower pots are shipped from the factory in large cartons or shipping containers in a number of spaced-apart stacks of upside-down flower pots. As described in U.S. Pat. No. 4,684,013, loading trays have been developed with cavities shaped in general conformance with the shape of the flower pot and spaced the same as the stacks of flower pots for removing the topmost pot in each stack and then the loaded tray is placed on the conveyor belt so that the flower pots can be filled and further processed. This saves considerable labor in removing the pots one at a time from the shipping container and also provides a convenient way for handling the pots for filling and processing and for storing the pots after they are filled and processed. While the loading tray of the '013 patent works quite well, it has been found that there is some lack of consistency. Too often one or more cavities stays empty, i.e., a pot from a stack doesn't stay in the cavity, which requires the user to manually insert a pot into the empty cavity. Other times, the tray cavity may pull out more than one pot at a time.

SUMMARY OF THE INVENTION

Similar to the loading tray in the '013 patent, the loading tray of this invention is made from a thin sheet of some suitable material, preferably an inexpensive plastic, either by vacuum forming or by injection molding so that the tray is somewhat resilient yet relatively stiff and has a series or plurality of cavities shaped and dimensioned to conform to the thin-walled plastic flower pots with which it is used. Close to but slightly spaced upward from the bottom of the cavity is an inwardly extending rib in the side wall of the cavity which firmly grasps onto the wall of the uppermost flower pot in a stack of upside down thin-walled flower pots to lift the top pot off the stack when the cavity is placed over the stack and pushed gently onto the stack and then removed. Preferably the rib is a horizontal elongated rib running lengthwise parallel to the bottom of the cavity. To insure more positive grasping, opposite facing ribs are located on the cavity wall so as to grasp the wall of the flower pot from opposite sides. As a further feature, the flower pots are provided with means for providing a gap or space between the bottoms of successively stacked pots so that the rib of the tray cavity will grasp the flower pot in the gap area thus making sure that the tray will extract only one pot from a stack.

DESCRIPTION OF PREFERRED EMBODIMENTS

Figure 1:
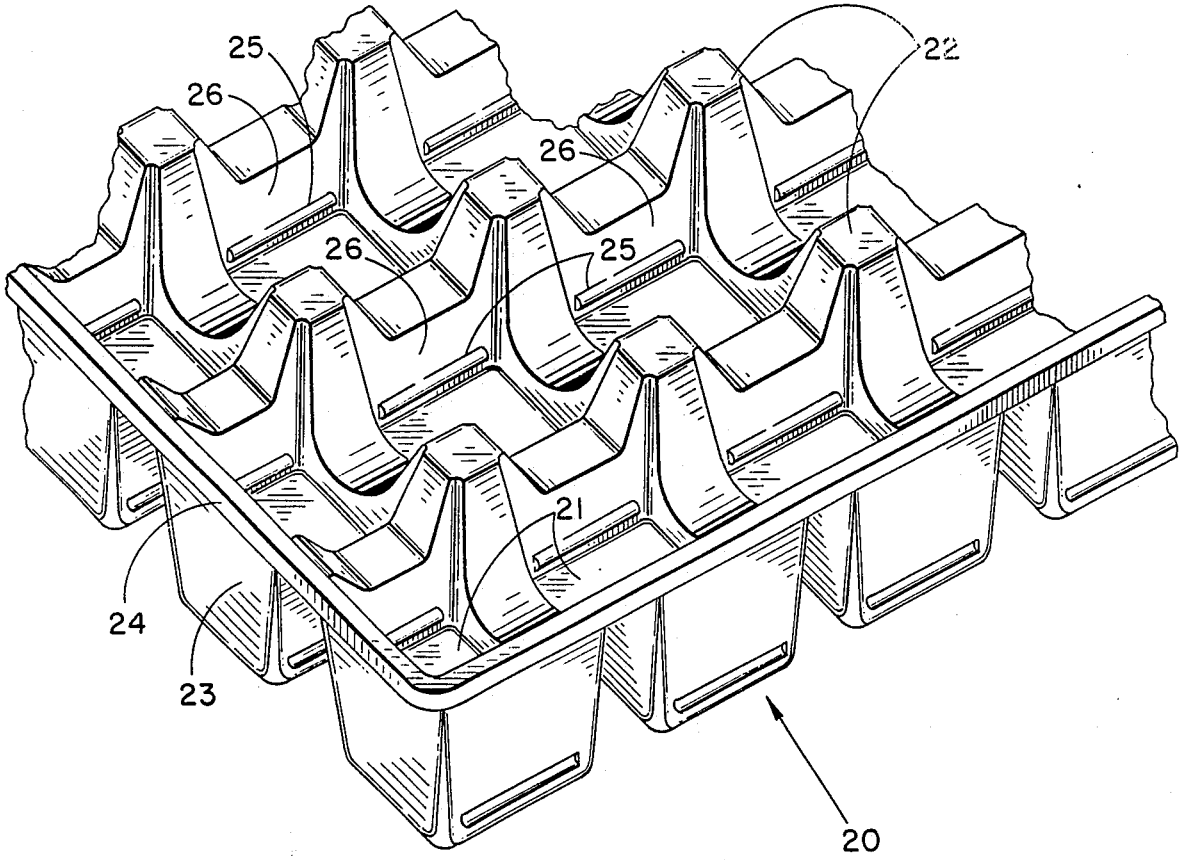
FIG. 1 is a perspective view of a portion of a loading tray right side up made according to the teachings of this invention.
Figure 2:
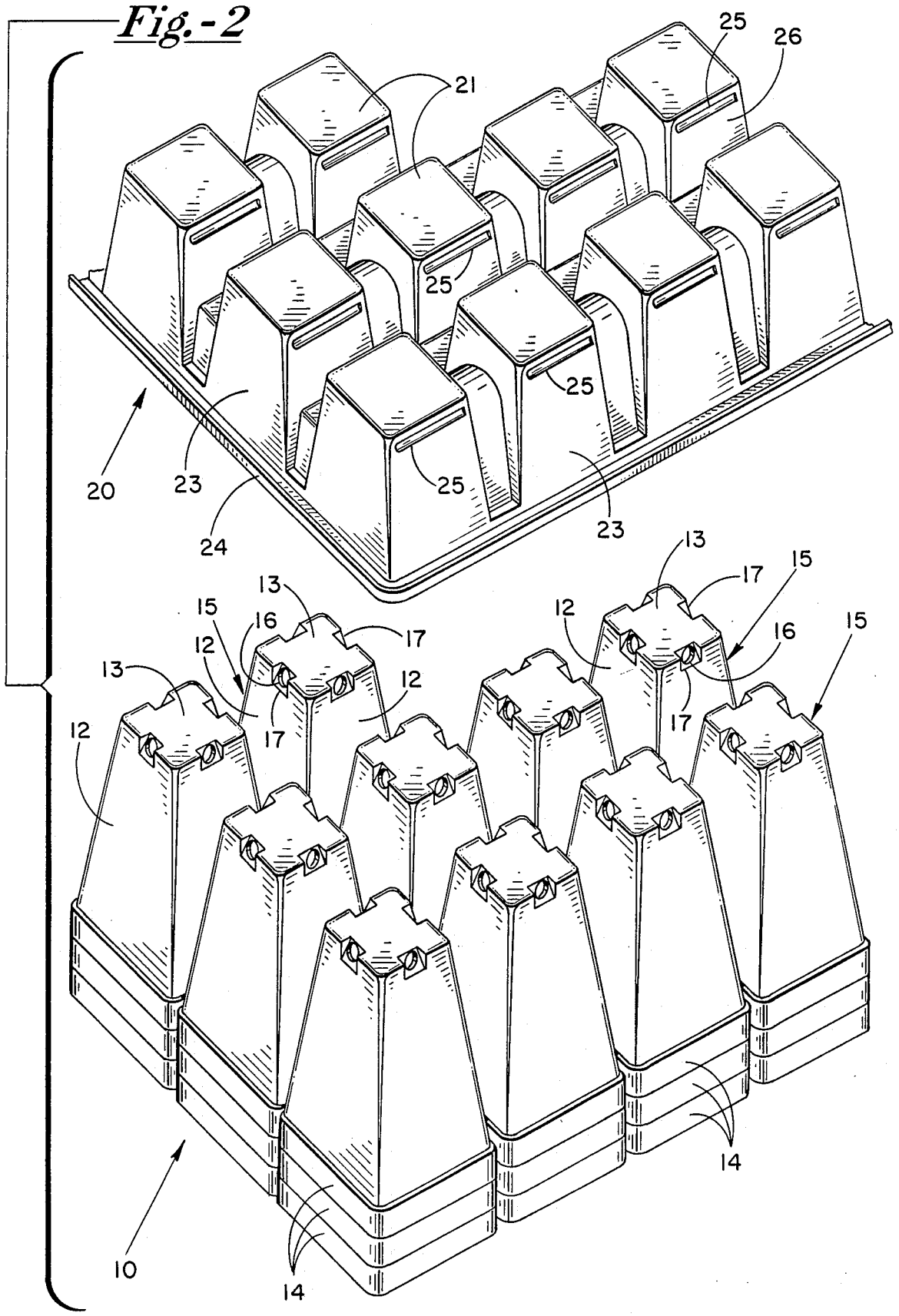
FIG. 2 is a perspective view of partial stacks of upside down pots and a loading tray positioned ready for filling or loading.
Figure 3:
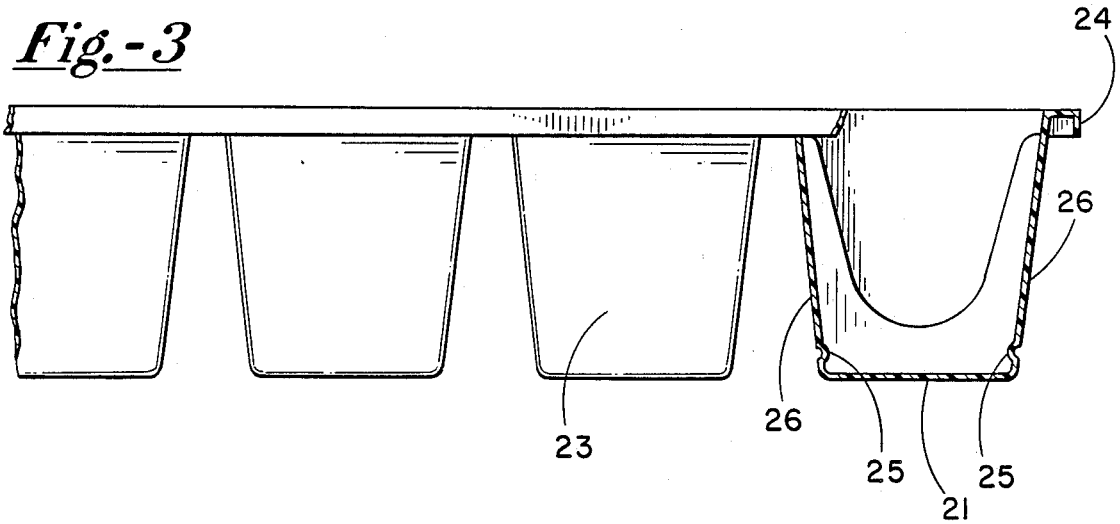
FIG. 3 is a vertical section of a tray cavity.
Figure 4:
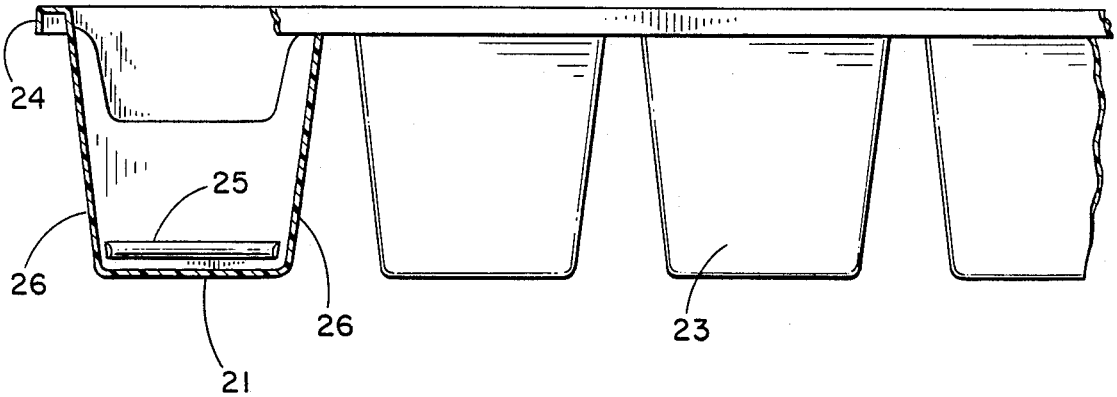
FIG. 4 is another vertical section view of a tray cavity.
Figure 5:
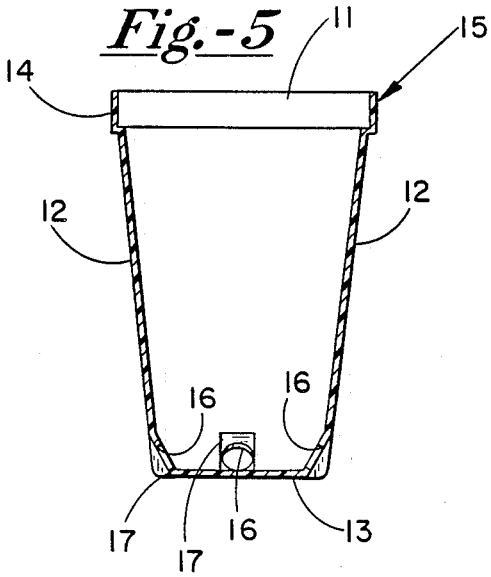
FIG. 5 is a vertical section view of a flower pot for use in accordance with the teachings of this invention.

In general, as mentioned earlier, it is standard practice to ship thin-walled plastic flower pots 15 from the manufacturer in a shipping container or carton, not shown, upside down in a set of stacks 10. To minimize shipping costs the stacks are close to one another and are arranged in what might be referred to as preset spaced rows and columns. Typically, no limitation being intended, the pots are made from high-impact polystyrene which has an initial thickness, before molding or forming, in the range of about 0.035 inch. Naturally, due to the molding or forming process, the plastic is somewhat thinner in certain areas of the finished product. A typical square or rectangular flower pot has a square opening 11 with truncated inwardly sloped walls 12 extending from the opening to a generally closed bottom 13. Conventionally the bottom usually has apertures or openings 16 and the wall may have recesses 17 in communication with the bottom openings 16 to permit water to drain out or seep in and allow warm air to circulate at the bottom of the flower pot when it is filled. Preferably each pot has a rim 14 around the open top. One form of rim 14 is a fairly narrow band which extends out from the side walls and is generally in a vertical plane as compared to the sloped side walls. When stacked upside down, what would normally be the top edge of the rim 14 of an upper pot rests on the underside edge of the rim 14 of the next lower flower pot in the stack. This provides a gap or space 18 (FIG. 6) between the bottoms of the stacked flower pots generally equal to the height or width of rim 14. A loading tray 20, which may be vacuum formed or injection molded using the same material as the flower pot, has a number of cavities 21 which are shaped and dimensioned to accept and hold the flower pots with the number of cavities being the same as the number of stacks of flower pots and the center-to-center spacing of the cavities being the same as the spacing of the stacks 10. A good portion of the wall area of the cavities is cut away, i.e., not formed during the molding process to save material and elevated land areas 22 at the corners where adjacent cavities meet provide strength for the tray. The tray may also contain additional recesses for saving material and for providing a conventional anti-nesting feature when the trays are stacked together for shipment, not part of the instant invention. Tray 20 has an outer enclosing wall 23 which also serves as a wall for the outside cavities with a lip or rim 24 around the top edge of the wall for strength and for aid in carrying the tray when it is loaded. Conventionally the bottom of the cavities also have apertures or openings and/or recesses, not shown, to permit drainage and air circulation when the filled pots are resting in the tray. On the wall 26 of the tray cavity close to but just above the bottom of the cavity is an inward projecting narrow rib 25 which is preferably horizontally elongated and extends at least part way across the wall generally parallel to the bottom of the cavity. Also preferably a rib 25 is formed at the same location on an opposite facing portion of the cavity wall.

Figure 6A:
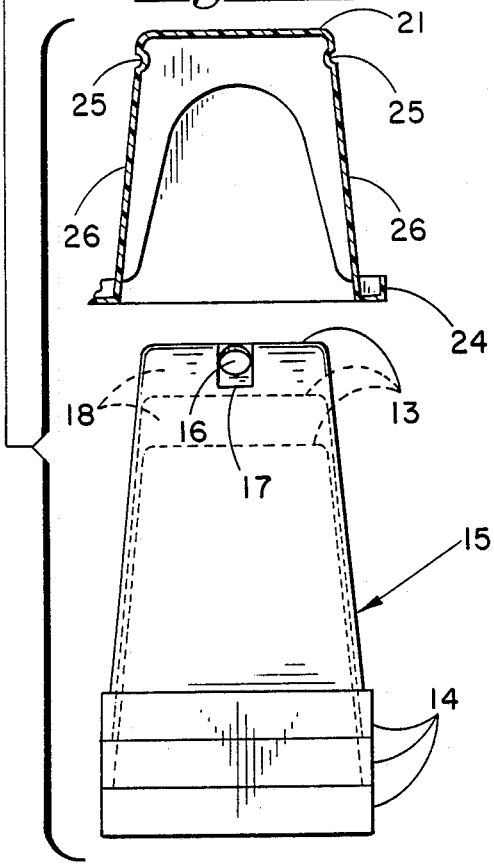
FIGS. 6 A, B, and C diagrammatically illustrate the operation of the preferred embodiment of the invention.
Figure 6B:
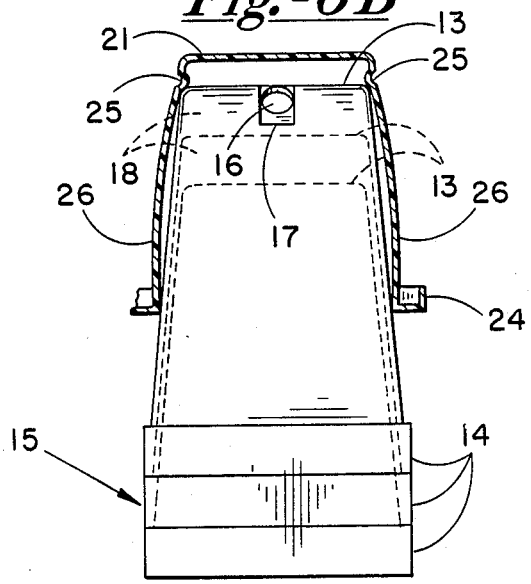
Figure 6C:
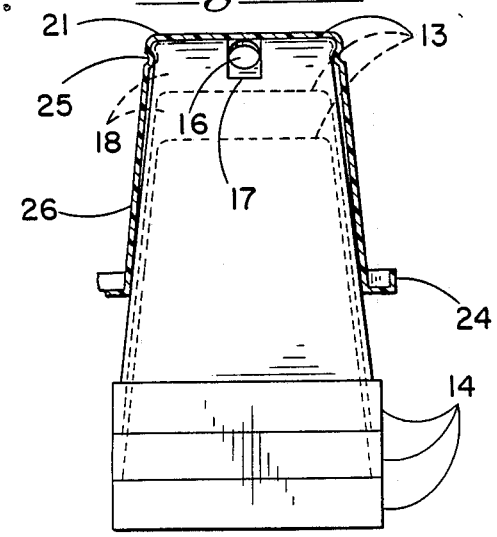

FIG. 6 is intended to illustrate the manner in which the loading tray is used to grasp the topmost stacked flower pot and to lift it off the stack and hold it in the cavity when the tray is lifted off the stacks. When the tray is placed upside down over the stacks 10 of upside-down flower pots 15 with each cavity of the tray centered with the center of a corresponding stack of pots, initially the rib 25 in the cavity wall 26 is above the bottom of the topmost pot, FIG. 6A. As the tray is moved onto the stacks and pushed gently but somewhat firmly down onto the stacks, ribs 25 contact the outer edges of the bottom of the topmost pot, see FIG. 6B. The transverse force of the edge of the pot bottom against the rib forces the side wall of the cavity with the rib to push outward slightly and then as the ribs 25 pass the bottom of the pot 13 into the space 18, see FIG. 6C, the cavity wall 26 springs back inward to its normal position and the force of the rib against the side wall of the pot causes the latter to bow inward slightly so that the rib then firmly grasps the flower pot at opposite facing side walls in the space or the gap 18 between the bottom of the uppermost pot and the next lower pot. When the tray is then lifted off the stacks, the topmost pot is quite firmly grasped and lifts off the stack without disturbing the remaining pots in the stack. The tray with a single pot in each of the cavities can then be placed right side up on a conveyor belt or the like for filling the pots and further processing. After filling and processing, the whole set of pots can be carried away the tray and stored or shipped. The trays can be reused after the pots have been removed. In general, the tray height is significantly less than the height of the pot not only to save material in the tray but also the pot then extends above the tray so it is convenient to remove individual pots from the tray.

Typically, for illustrative purposes only with no limitation being intended, flower pots for use in accordance with the teachings of this invention may be shipped in a shipping container containing thirty-two stacks arranged in four rows and eight columns. The top opening at the rim may be in the order of about two and one-half inches square with the truncated walls extending to a bottom which is in the order of about one and one-half inches square and an overall height of about three and one-half inches. A corresponding loading tray has its cavities in the same four by eight arrangement with the center-to-center spacing between adjacent cavities being in the order of about 2.65 inches and having an overall height from the bottom of the cavity to the top of the lip surrounding the tray in the order of about 2.3 inches.

I claim:

1. In a loading tray for a plurality of stacks of upside-down, thin-walled, plastic flower pots arranged in preset spaced rows and columns, said tray made of thin, somewhat resilient, relatively stiff plastic and having a plurality of cavities spaced in the same arrangement as the stacked flower pots, each of the cavities having an open top and inwardly downward tapering side walls, the improvement comprising:

an inward extending elongated rib in a sidewall of each cavity near but spaced upward from the cavity bottom and running lengthwise parallel to the cavity bottom for grasping in each cavity a single flower pot from the stacks of flower pots when the tray is placed with the open top of the cavities over the stacks of upside-down flower pots and pushed gently onto the stacks and then lifted off the stacks.

2. The loading tray as described in claim 1 wherein the rib is located in the cavity to grasp the flower pot in close proximity to the bottom of the flower pot.

3. The loading tray in claim 1 wherein a rib is located on two opposite facing sidewalls of the cavity.

4. A system for loading a plurality of thin-walled plastic flower pots into a loading tray, comprising:

a plurality of preset spaced stacks of upside-down, thin-walled, plastic flower pots, each flower pot having an open end and an enclosing wall sloping inward to a substantially closed bottom and means for providing a gap between the bottom of each flower pot and the next lower flower pot in the stack; and a loading tray made of thin somewhat resilient relatively stiff plastic having a plurality of pot holding cavities spaced in the same preset spacing as said stacks of flower pots, each of said cavities having an open top and inwardly sloped enclosing walls conforming to the slope of the flower pot wall and inwardly extending rib means on the cavity wall located just above the bottom of the cavity for grasping the topmost pot in a stack in the gap between the bottom of the pot and the bottom of the next lower pot in the stack when the tray is placed with the open top of each cavity over a corresponding stack of upside-down pots and gently pushed onto the stacks and then lifted off the stacks.

5. A system for loading thin-walled plastic flower pots into a tray as described in claim 4 wherein said means for providing a gap between the bottoms of the stacked pots comprises a rim around the opening of each pot such that the topside of the rim on a pot in the stack rests on the underside of the rim of the next lower pot in the stack.

6. A system for loading thin-walled plastic flower pots into a loading tray as described in claim 4 wherein said rib means is elongated and runs lengthwise generally parallel to the bottom of the cavity.

7. A system for loading thin-walled plastic flower pots into a loading tray as described in claim 6 wherein said rib means are on oppositely facing sides of the cavity wall.

* * * * *